United States Patent [19]

Honda et al.

[11] 4,152,094

[45] May 1, 1979

[54] AXIAL FAN

[75] Inventors: Juichi Honda, Fujisawa; Tatsumi Tamaki, Tokyo; Akira Suzuki, Nagareyama; Yoshimi Inoue, Tokyo, all of Japan

[73] Assignee: Hitachi, Ltd., Japan

[21] Appl. No.: 733,050

[22] Filed: Oct. 18, 1976

[30] Foreign Application Priority Data

Oct. 31, 1975 [JP] Japan ..... 50-130451
Apr. 21, 1976 [JP] Japan ..... 51-44459

[51] Int. Cl.[2] ..... F01D 25/04

[52] U.S. Cl. ..... 415/119; 415/126; 415/DIG. 1

[58] Field of Search ..... 415/119, 126, 205, 208, 415/210, DIG. 1, 216

[56] References Cited

U.S. PATENT DOCUMENTS

| | | | |
|---|---|---|---|
| 3,776,363 | 12/1973 | Kuethe | 415/119 X |
| 3,832,085 | 8/1974 | DeFauw et al. | 415/119 |
| 3,873,231 | 3/1975 | Callahan | 415/119 X |
| 3,893,782 | 7/1975 | Pierpoline et al. | 415/119 |
| 3,947,148 | 3/1976 | Holt | 415/119 |

*Primary Examiner*—Carlton R. Croyle
*Assistant Examiner*—Leonard E. Smith
*Attorney, Agent, or Firm*—Craig & Antonelli

[57] ABSTRACT

The disclosure is concerned with an axial fan having a casing. Unacceptably high level of noise and low discharge pressure inherent in axial fans are attributable to a counter flow of fluid taking place through the gap between the radially outer ends of the rotating blades and the casing. The invention is directed to preventing the counter flow by providing guide vanes disposed in the gap and inclined symmetrically with the rotating blade, thereby to provide enhanced output flow rate and discharge pressure, as well as to reduce the level of noise. The invention is applicable also to such axial fan as having a baffle plate on the suction side of the rotating blade in the proximity thereof.

20 Claims, 27 Drawing Figures

AXIAL FAN

The present invention relates to an axial fan or blower having a casing. In known conventional fans of this kind, air sucked through a suction space of the fan is energized by a rotating blade of the fan and then is discharged from the discharge space as a swirling flow. It is a known phenomenon that as the swirling flow is discharged, the pressure within the discharge space is raised especially at those areas close to the radially outer ends of the rotating blade, which inconveniently causes a three dimensional counter flow or spiral flow of air from the discharge space to the suction space through a slight gap between the inner surface of the casing and the radial end of the rotating blade. Consequently, the discharge rate or flow rate of air is largely decreased with an enhanced level of noise.

Conventionally, this disadvantageous counter flow has been avoided through providing a minimum allowable gap between the inner surface of the casing and the outer ends of the rotating blade. However, this way of solution requires an impractically high dimensional accuracy in machining and assembling, which renders the axial fan substantially expensive. Under this circumstance, Japanese Patent Publication No. 4593/1970 discloses an axial fan having an annular member of an axial length larger than that of the rotating blade, which body member is attached to the radial end of the rotating blade to be rotated therewith within the casing, while Japanese Utility Model Laid-Open Publication No. 58035/1975 discloses a axial fan in which the minimum gap is provided between a bellmouth carried by an annular ring or a shroud ring secured to the radial end of the rotating blade and the inner surface of the casing. These structures have been found also unacceptable in that an enhanced dimensional accuracy and, accordingly, a raised cost are resulted. Japanese Pat. Publication No. 20491/1973 discloses another way of solution in which a rotating blade is provided with an internal bore opening at the inner and outer radial end of the blade. A radial flow of air is produced by a centrifugal blade provided at the root portion of the rotating blade for flowing through the internal bore so that the air discharged from the radial end of the rotating blade may increase the pressure at the gap between the rotating blade and the casing thereby to prevent the counter flow. This way of solution, however, requires a complicated structure of the rotating blade and therefore, is impractical. Japanese Pat. Laid-Open Publication No. 63508/1975 proposes still another arrangement in which a convex volute chamber is disposed symmetrically with respect to the axis of the rotating blade within the casing to surround the rotating blade. An annular vortex flow of air is generated by the rotating blade within the volute chamber which conveniently reduces the turbulence at the radial end of the rotating blade promising a reduced level of noise. This type of axial fan is also unsatisfactory in that an impractically complicated structure including a volute chamber partially accommodating the blade is required.

Thus, although the problem derived from the counter flow at the gap between the casing and the blade ends have been pointed out for a long time, no practical way of solution has been presented up to now, and the problem has been left unsolved.

Apart from the above, Japanese Pat. Publication No. 43606/1974 proposes an axial fan having flow-direction reversing means consisting of a baffle plate disposed on the suction side of the rotating blade. The plate is adapted to be moved to provide a radial suction opening so that the fan is changed into a centrifugal fan for displacing the air mass in the reverse direction, i.e. from the discharge side to the suction side of the axial fan, when the plate is moved to the close proximity of the rotating blade. This type of axial fan suffers a problem of too large axial length of the blower assembly as well as of the counter flow, due to the presence of the baffle plate disposed axially outwardly of the rotating blade. A modification of this type of fan having a casing completely accommodating the rotating blade and a baffle plate disposed in the close proximity of the rotating blade is also unacceptable in that the output flow rate is inevitably reduced, which can be compensated for only through adopting a larger axial length.

It is therefore an object of the invention to improve the blast performance of axial fan, as well as to lower the level of noise, through preventing the disadvantageous counter flow by orienting the circumferential component of the air flow from the rotating blade.

It is another object of the invention to reduce the axial length of those axial fan having a baffle plate close to the suction side of the rotating blade.

According to the invention, there is provided an axial fan having guide vanes disposed in the space defined by the radial outer end of the rotating blade and the inner surface of the casing. The guide vanes are arranged to have angles of twisting opposite to those of the rotating blade.

These and other objects, as well as advantageous features of the present invention will become more clear from the following description of the preferred embodiments taken in conjunction with the attached drawings in which.

Figure 1:
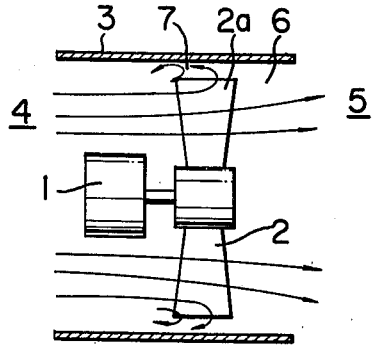
FIG. 1 is a longitudinal sectional view of an essential part of a conventional axial fan.

Referring to FIG. 1, a typical conventional axial fan is shown to have a cylindrical casing 3 accommodating a motor 1 and rotating blade 2 mounted on the shaft of the motor 1. A suction space 4 and a discharge space 5 are defined, respectively, at the left-hand side and the right-hand side of the rotating blade. The arrangement is such that the air sucked through the sucking space 4 is energized by the rotating blade 2 and discharged through the discharge space 5 in the form of a swirling flow.

Figure 2:
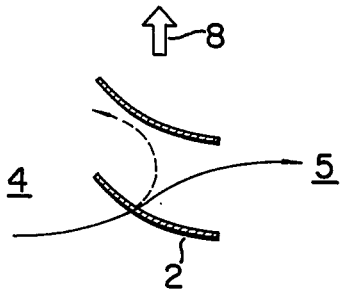
FIG. 2 is a circumferential sectional view of the fan of FIG. 1 and is for explaining the direction of flow of air around the rotating blade.
Figure 3:
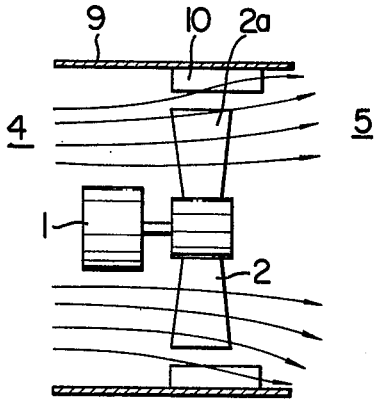
FIG. 3 is a longitudinal sectional view of an essential part of an axial fan embodying the present invention.
Figure 4:
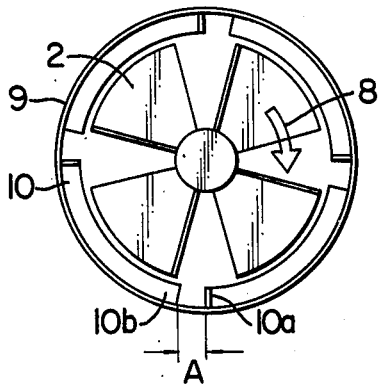
FIG. 4 is a front elevation of the fan of FIG. 3.

As the discharged air increases, a local pressure-rise takes place within the discharge space particularly at the area 6 around the radially outer end 2*a* of the rotating blade 2, which causes a three-dimensional counter flow or a spiral flow through a gap or space 7 formed between the blade end 2*a* and the internal surface of the casing 3 to be passed from the discharge space 5 to the suction space 4, as will be seen from FIG. 1. Referring to FIG. 2, the rotating blade 2 rotates in the direction of an arrow 8, which allows a certain amount of air from the suction space 4 to the discharge space 5 as shown by full lines, while the counter flow as explained above takes place within the space 7 as illustrated by a broken line. It will be understood that this counter flow substantially reduces the output flow of the fan and inconveniently enhances the level of noise.

Figure 5:
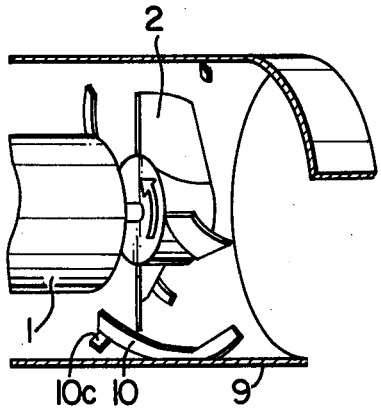
FIG. 5 is a partially sectional perspective view of the fan of FIG. 3.
Figure 6:
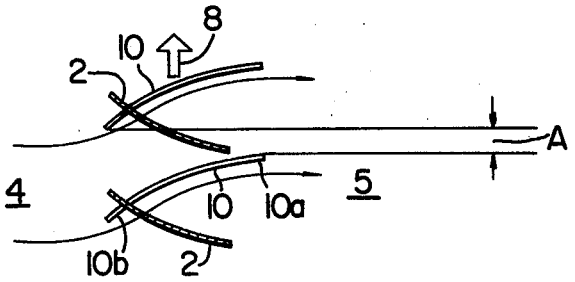
FIG. 6 is a circumferential sectional view of the fan of FIG. 3 and is explanatory of the flow of air around the rotating blade.

Referring to FIGS. 3 to 6 showing an axial fan which is a preferred embodiment of the invention, a casing 9 has an inner diameter larger than those of conventional fans to provide a sufficient space between the blade end 2*a* and the inner surface of the casing 9. A plurality of guide vanes 10 are disposed in a circumferential row within the space. The guide vanes 10 are helically twisted in a symmetrical direction to the rotating blade with respect to the axis of the rotating blade. The words "twisting angle of rotating blade" will be used hereinafter to denote the angle formed between the rotating blade and a plane normal to the axis of the rotating blade. Thus, the guide vanes 10 are so arranged as to have twisting angle and shape which are symmetrical to those of the rotating blades 2 with respect to the axis of the rotating blade, so as to guide the three-dimensional swirling flow by centrifugal, rotational and axial forces caused by the rotation of the rotating blade, as seen from FIG. 6. As shown in FIG. 6, the end 10*a* of a guide vane 10 on the side of the suction space 4 is close by a distance A in the circumferential direction of the end 10*b* of the adjacent guide vane 10 on the side of the discharge space 5. No substantial difference other than described exists between the axial fan of this embodiment and the known fans.

Since the guide vanes 10 are arranged to introduce the circumferential component of air flow toward the discharge space 5, the swirling flow of air around the blade end 2*a* is smoothly guided along the guide vanes 10 toward the discharge space 5, as shown by a full line in FIG. 6. It will be seen that the axial fan no longer suffers a disadvantageous local pressure-rise around the blade end 2*a*, which has inevitably occurred in conventional fans, so that the counter flow and spiral flow do not take place thereby promising a much increased output flow rate and discharge pressure, as well as sufficient reduction in noise level.

Figure 7:
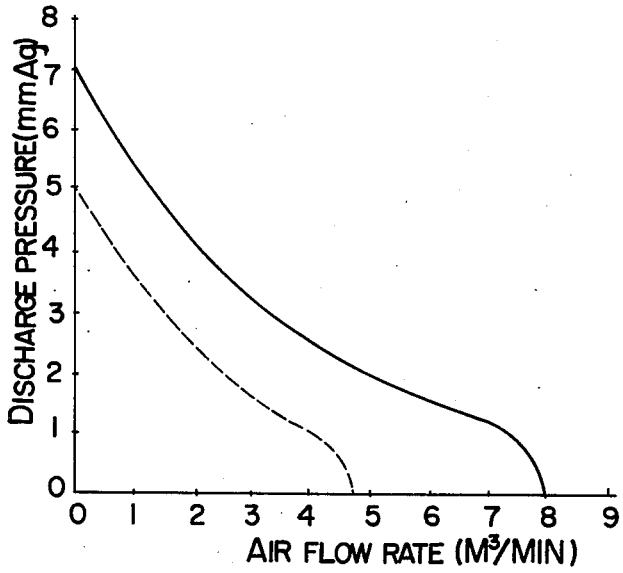
FIG. 7 is a graph showing a dynamic characteristic of the axial fan embodying the present invention.
Figure 8:
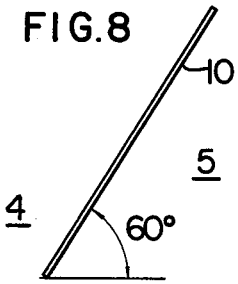
FIG. 8 is a developed view of a guide vane incorporated in the fan of the present invention.

These remarkable effects can be clearly observed in FIG. 7 which show a result of a experiment carried out for the purpose of comparison of an axial fan embodying the present invention with a conventional axial fan. The experiment was conducted with an axial fan of the invention having six guide vanes each of which was 50 mm in axial length and 10 mm in radial height. The guide vanes are disposed in a linear and circumferential row along the inner periphery of the casing and are inclined at, 60° with respect to the line of the rotating blade as shown in FIG. 8. The casing has an inner diameter of 180 mm. The fan has rotating blade of 150 mm in outer diameter and 45 mm in axial height. The conventional fan employed in the experiment has the same size and structure including the rotating blade as those of the fan of the invention, except that it has an internal diameter of casing of 160 mm and that it lacks guide vanes. These fans were operated at 2000 r.p.m. to provide respective characteristics, as shown in FIG. 7, in which the full line represents the characteristic of the fan in accordance with the invention, whereas the broken line shows that of the conventional fan. It will be seen that the output flow rate and the discharge pressure given by the fan of the invention exceed those of the conventional fan by some 50%, respectively. At the same time, it was confirmed that the noise level is reduced by 4 dB in the fan of the invention, as compared with the conventional fan.

The experiment also teaches optimum arrangement and structure of guide vanes, as follows.

Namely, it has proved through the experiment that a most remarkable effect is obtained when the guide vane has a radial height which amounts to 5 to 15% of the outer diameter of the rotating blade and an axial length greater than that of the rotating blade. Since the guide vanes serves to direct the swirling flow of air from the rotating blade toward the discharge space, it is recommended that the guide vanes are inclined with respect to the axis of the rotating blade in symmetry with the rotating blade, so that the guide vanes and the rotating blade intersects with each other in plan at an angle of, preferably, about 90°. However, it is not the angle between the guide vanes and the rotating blade but the angle of the guide vanes with respect to the direction of the swirling flow that is of significance in obtaining a good result.

Although flat guide vanes are used in the experiment, the guide vane preferably has a convexed surface confronting the suction side of the rotating blade, as shown in FIG. 6, so that the swirling flow may be guided in a smoother manner.

In order to prevent the counter flow, it is preferable that an end 10*a* of a guide vane overlaps the opposite end 10*b* of the neighbouring guide vane, when viewed axially of the fan. However, this is not critical and a small gap A (See FIGS. 4 and 6) between the ends 10*a* and 10*b* is acceptable.

It will be understood that the gap A can be reduced by adopting a larger axial length of the guide vane, while the number of guide vanes can be reduced for a given gap A by adopting guide vanes of larger axial length.

FIG. 5 shows guide vanes 10 attached to the inner peripheral wall of the casing 9 at an integral attaching tab 10*c* by means of spot welding and the like. In this arrangement, it is necessary to make the gap between the guide vanes 10 and the casing 9 as small as possible.

Figure 9:
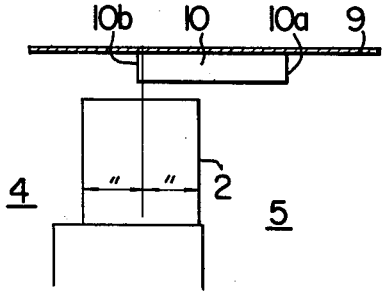
FIG. 9 is a longitudinal sectional view of an essential part of another embodiment of the present invention.

Although the guide vanes extend in the axial direction of the casing over the entire axial extent of the rotating blade, this is not exclusive and almost the same performance as given by the arrangement of FIG. 6 can be obtained by arranging the guide vanes as shown in FIG. 9. In this arrangement, the ends 10*b* of the guide vanes close to the suction space 4 are positioned preferably on the side of the center line of the rotating blade close to the suction space 4. It is also preferable that the guide vanes has an axial extent greater than that of the rotating blade. It will be understood that, in view of the teachings of the invention, it is meaningless to locate the guide vanes close to the suction space 4, since such guide vanes can never affect the swirling flow discharged from the rotating blade toward the discharge space.

Figure 10:
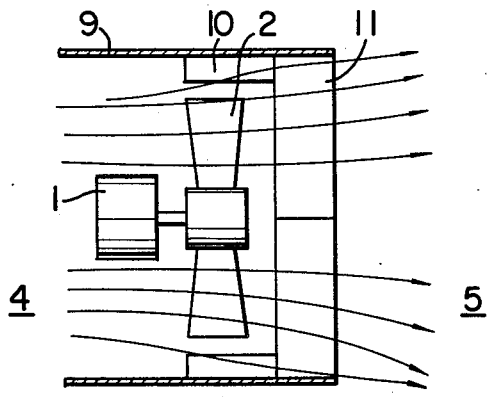
FIG. 10 is a longitudinal sectional view of an essential part of still another embodiment of the present invention.
Figure 11:
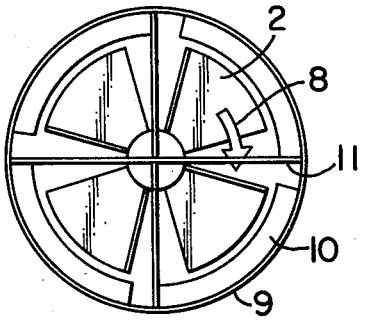
FIG. 11 is a front elevation of the embodiment of FIG. 10.
Figure 12:
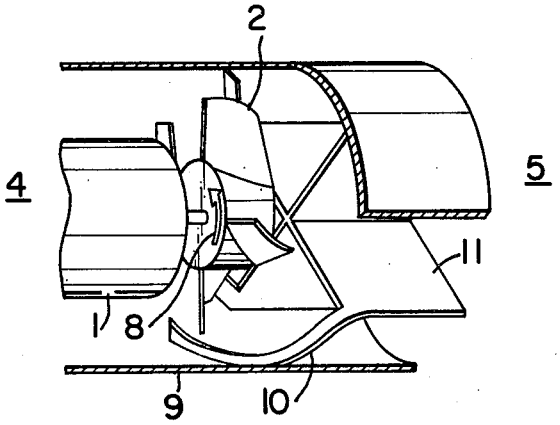
FIG. 12 is a partially sectional, perspective view of the embodiment of FIG. 10.

FIGS. 10 to 12 show another embodiment having known stator blades 11 disposed in the discharge space 5 and connected to the guide vanes. The flow of air is guided smoothly along the guide vanes and then the stator blades 11, so that the level of noise is significantly reduced.

Figure 13:
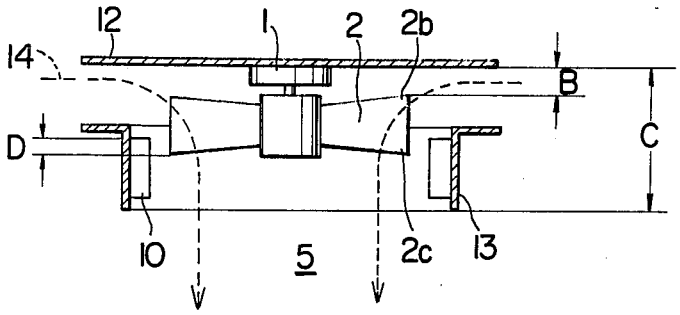
FIG. 13 is a longitudinal sectional view of a further embodiment of the invention.

Referring to FIG. 13 which shows still another embodiment, a baffle plate 12 is provided at the suction side of the rotating blade 2 in close proximity thereof. The rotating blade 2 is partially surrounded in axial direction by a casing 13. An intake or suction opening 14 is defined to open in the radial direction of the rotating blade 2 between the baffle plate 12 and the casing 13. The guide vanes 10 are arranged in a similar manner to the embodiment of FIG. 9. Assuming here that there were no provision of guide vanes 10, the output flow rate would be decreased as the distance B between the baffle plate 12 and the axial end 2*b* of the rotating blade 2 reduced, and the closer proximity of the baffle plate 12 to the blade end 2*b* changed the fan into a centrifugal fan adapted to discharge air from the discharge space 5 to the suction space 4. However, according to the invention, the distance B can be reduced without impeding the air flow from the suction space 4 to the discharge space 5, so that the total length C from the downstream side end of the casing 13 to the baffle plate 12 can conveniently be reduced owing to the provision of the guide vanes 10.

This advantageous characteristic of the invention is derived from the reason as described hereinafter with reference to FIGS. 14A, 14B, 15A and 15B. The description will be made in comparison with such a type of fan or blasting means as can be changed into a centrifugal fan on condition that there is no provision of guide vanes.

Figure 14A:
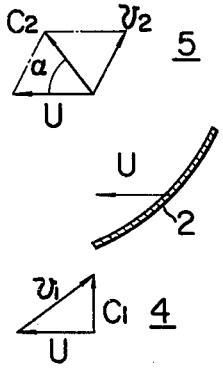
FIG. 14 shows a velocity vector diagram when the distance between the rotating blade and a baffle plate is relatively large.
Figure 14B:
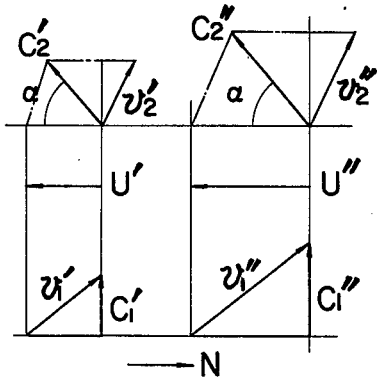

The air staying around the rotating blade is forced to flow in the tangential direction of the blade due to a combined force of rotational, centrifugal and thrusting forces, as the rotating blade starts to rotate. Supposing that the distance B is sufficiently large, supplementary air is induced from the suction side of the rotating blade in the axial direction thereof at an inlet velocity $C_1$ as shown in FIG. 14A. The induced air is then energized by the rotating blade and is forced toward the discharge space 5 forming a swirling flow at an outlet velocity $C_2$. An outlet angle $\alpha$ is formed between the direction of the swirling flow and a plane normal to the axis of rotation of the rotating blade. When the speed of rotation of the rotating blade remains low, i.e. immediately after the start, the air is induced from the suction side of the blades at an inlet velocity $C'_1$ which substantially corresponds to the speed N of rotation, and is discharged from the rotating blade at an outlet velocity $C'_2$ and at an outlet angle $\alpha$, as shown in FIG. 14B. As the speed N of rotation of the rotating blade becomes higher, the circumferential velocity U of the rotating blade is increased dependent on U''. However, this increase of the circumferential velocity does not cause substantial change in the outlet angle $\alpha$, since the sufficiently large distance B allows the increased rate of air to pass so that the inlet velocities are correspondingly increased to $C''_1$.

Figure 15A:
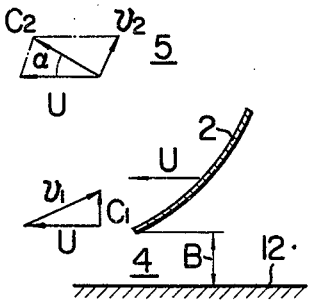
FIG. 15 shows a velocity vector diagram for a relatively small distance between the rotating blade and the baffle plate.
Figure 15B:
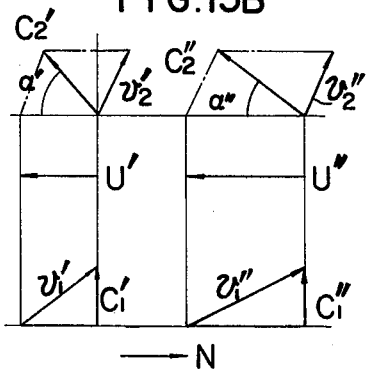

To the contrary, supposing that the distance B is small, the baffle plate act as a resistance against the inlet flow of air, so that the air is induced from the suction side of the rotating blade only at a small rate, with small inlet velocity $C_1$ and a small outlet angle $\alpha$, as will be seen from FIG. 15A. At a low speed of rotation of the rotating blade, an outlet angle $\alpha'$ which well compares with the outlet angle $\alpha$ (FIG. 14B) for the large distance B is obtained, in spite of a small rate of air flow, due to correspondingly small circumferential velocity U of the rotating blade, as will be seen from FIG. 15B.

However, as the circumferential velocity U increases due to the increase of the revolution speed, the outlet angle is reduced to $\alpha''$, since the inlet velocity does not increase correspondingly due to the presence of resistance by the baffle plate. Thus, as the speed of rotation increases, the outlet flow of air comes to be directed radially of the rotating blade, so that air flow is prevented from flowing into the fan in the radial direction of the rotating blade. It will be understood that a further increase of the speed of rotation causes sucking air from the discharge space 5, since the very small distance B prevents air from being induced through the suction space 4, and resultant discharge of air from the suction space 4. Thus, the fan now acts as a centrifugal fan which induces air from the discharge space 5 and discharges from the suction space 4, if there is no provision of guide vanes.

Turning again to FIG. 13, guide vanes 10 are disposed within the space between the casing 13 and the radially outer end of the rotating blade 2. The guide vanes 10 extend over the rotating blades 2 in the axial direction thereof. It is to be noted that the guide vanes 10 are so arranged as to conform the outlet angle $\alpha'$ of air toward the discharge space 5 which angle is established when the rotation speed remains low. Therefore, when the speed of rotation is low, the discharged air is conveniently guided by the guide vanes 10 toward the discharge space 5. Accordingly, the resultant vacuum induces supplementary amount of air large enough to provide a large inlet velocity $C_1$ and, accordingly, a large outlet angle $\alpha$.

Thus, once the large outlet angle $\alpha$ is established, the air is continuously induced through the suction space 4 and discharged through the discharge space 5, even when the speed N of rotation of the rotating blades is increased. When the rotating blade rotates at the rating speed, part of air is delivered along the guide vanes 10, of which the remainder is discharged directly from the rotating blade 2 to the discharge space 5.

It will be seen that the guide vanes are effective to force air to flow toward the discharge space 5, enhancing the inlet flow through the suction space 4, during which the speed of rotation is increased from zero to the rating or normal running speed. Therefore, no reversing of air flow takes place, which would occur when there is no provision of guide vanes.

The location, orientation, angle of inclination, height, number and other factors of the guide vanes should be selected so as to meet the above described nature of operation.

For the information, supposing that an axial fan having no guide vanes 10 were started and running as a centrifugal fan which delivers air from the discharge space to the suction space of the axial fan, the fan would continue to serve as a centrifugal fan, even if the guide vanes are inserted to the already running fan. This is because there is no swirling flow around the guide vanes, heading for the discharge space, once the fan becomes a centrifugal fan.

To the contrary, supposing that the guide vanes are removed from the fan which is running as an axial fan, the fan would continue to serve as an axial fan, because the large inlet velocity $C_1$ and the large outlet angle $\alpha$ are effective, once they are established, to induce the supplementary air thereby to maintain the ordinary output flow.

Although rotation has been described in comparison with a blower lacking the guide vanes and capable of being changed into a centrifugal fan, the invention is applicable to such a fan as having a large distance B since the guide vanes can always function to guide and discharge the swirling flow taking place around the rotating blade. It has proved that when the invention is applied to a blower incorporating a baffle plate, guide vanes as shown in FIG. 6 is still effective and that the guide vanes extend over 70% to 150% of the axial extent of the rotating blade and a radial height of preferably between 3% and 20% of the outer diameter of the rotating blade.

Figure 16:
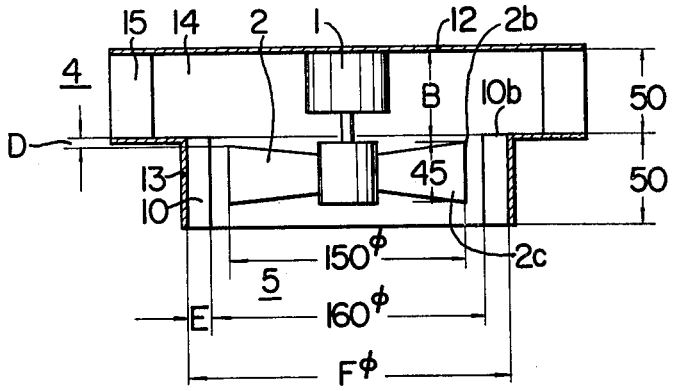
FIG. 16 is a longitudinal sectional view of an experimental machine in accordance with the invention.
Figure 17:
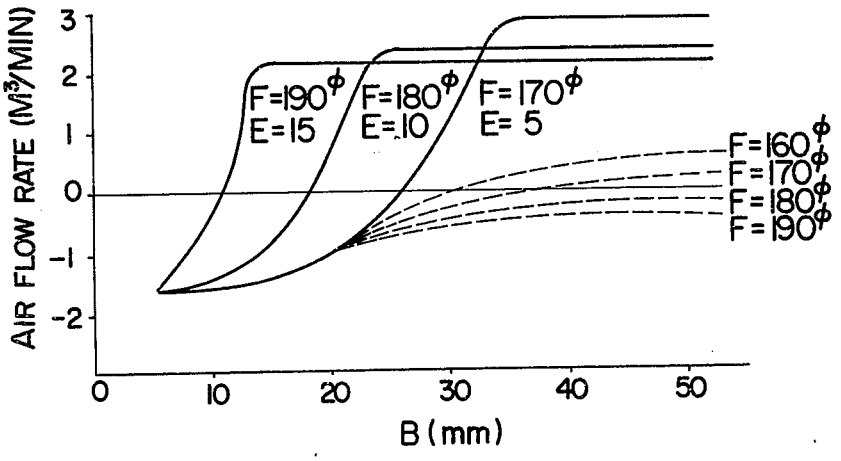
FIG. 17 is a graph showing a dynamic characteristic performed by the experimental machine of FIG. 17.

FIG. 17 shows a result of an experiment executed for confirming the performance of the fan of FIG. 13. The fan employed has a structure generally shown in FIG. 16. In the experiment, the output flow rate of air was measured with parameters of radial height E of the guide vanes 10 and the distance B between the suction side ends 2*b* of the rotating blade and the baffle plate 12. For the purpose of comparison, the output flow rate was measured also for a blower having no guide vanes, in an equivalent condition, the result of which is given by broken lines in FIG. 17. Rotating blade having an outer diameter of 150 mm was operated at 1400 r.p.m., in both cases of guide-vanes-equipped and non-equipped fans. The inner diameter of the guide vanes was kept constant at 160 mm. Eight linear guide vanes each having axial extent of 50 mm and each being inclined or twisted by 45° were incorporated. The radial height E of the guide vanes was changed in three stages of 5 mm, 10 mm and 15 mm. The distance between the casing 13 and the baffle plate 12 was kept constant at 50 mm. In the fan used in the experiment, a fin-and-tube type heat exchanger was fitted into the space between the casing 13 and the baffle plate 12. The axial length of the casing 13 surrounding the guide vanes was 50 mm. Thus, the distance D between the suction side ends 10*b* of the guide vanes and the end 2*b* of the rotating blade was changed in accordance with the change in the distance B.

In FIG. 17, the output flow rate is shown in minus (−) to represent the reverse flow, i.e. the flow directed from the discharge space 5 to the suction space 4. It will be seen from FIG. 17 that the fan can act to provide the ordinary direction of flow even with a small distance B, as shown by full lines, when the guide vanes are incorporated, while the fan acts as a centrifugal fan over almost all range of B, when there is no provision of guide vanes 10, as shown by broken lines. At the same time, it is observed the output flow rate is stable for the varying distance B. It will be seen also from FIG. 17 that the smaller distance B can be obtaind by adopting the large radial height E of the guide vanes. It is to be noted that the distance B with which the direction of flow changes depends not only on the factors of the rotating blade and the guide vanes but on the resistance provided by the heat exchanger 15 as well.

It is to be understood, while the invention has been described with specific embodiments, that various changes and modifications are possible as follows.

Figure 18:
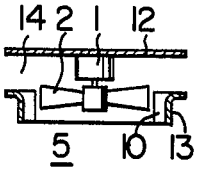
FIGS. 18 to 24 are longitudinal sectional views of different further embodiments of the present invention.
Figure 19:
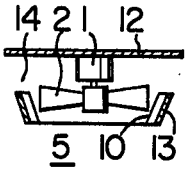
Figure 20:
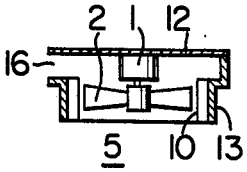
Figure 21:
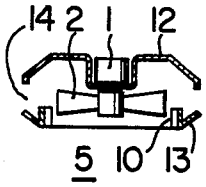
Figure 22:
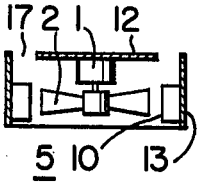
Figure 23:
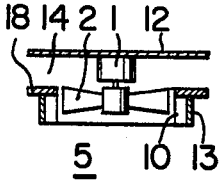
Figure 24:
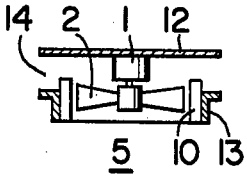

The casing 13 can have a curved suction side end as shown in FIG. 18 or can converge toward the discharge side end as shown in FIG. 19. It is also possible to neglect the surface of the casing 13 confronting the baffle plate, as shown in FIG. 19. FIG. 20 shows another modification in which a suction opening 16 is provided at only one side of the suction space. A curved or convexed baffle plate can be adopted for facilitating the attaching of the motor or for other reasons including the matter of design, as shown in FIG. 21. In the modification as shown in FIG. 22, the suction opening 17 opens axially between the casing and the rotating blade. FIG. 23 shows a further embodiment in which the baffle plate is secured to the suction side end surface of the guide vanes, while FIG. 24 shows a still further embodiment in which guide vanes projects into the space between the casing and the baffle plate.

Owing to the advantageous features as described, the invention can be applied to various uses. For example, a reversible fan or blasting means can be obtained by having the baffle plate arranged movable, which blasting means can conveniently perform not only sucking but forced-drafting as well. This will be clear from the result of the test as shown in FIG. 17, according to which the fan can act as a centrifugal fan capable of discharging air in the reversed direction at a rate of 1.5 $m^3$/min, when the distance B is reduced to 5 mm. It is to be noted that the fan can become suction or exhaust means by having the rotating blades arranged removably.

In addition, it is remarkable that the reversible blasting means described above can advantageously be combined with a heat exchanger as shown in FIG. 16 to provide a reversible and reduced-sized air conditioner. Namely, by installing the reversible blasting means incorporating a heat exchanger on a ceiling with its discharge space directed downwardly, it is possible to discharge hot air downwardly by increasing the distance B, and to discharge cold air upwardly and laterally by reducing the distance B.

In the foregoing description, the baffle plate has been shown to have no perforation. However, small bore or bores capable of passing limited amount of air may be formed, as far as the plate functions materially as a baffle plate.

Although several preferred embodiment have been described with specific terms, it is to be understood that many changes and modifications can be imparted thereto without departing from the scope of the invention which is limited solely by the appended claims.

What is claimed is:

1. An axial fan comprising a rotating blade, motor means drivingly connected to said blade for effecting rotation thereof, a casing having an inner diameter larger than the outer diameter of said rotating blade and a plurality of guide vanes secured to the inner surface of said casing and having a radial height smaller than the radial gap defined between said casing and said rotating blade, each of said guide vanes having a thickness of substantially the same order as that of said rotating blade and being twisted in the opposite direction to the direction of twisting of said rotating blade.

2. An axial fan comprising a rotatable blade, motor means drivingly connected to said blade for effecting rotation thereof, a casing covering at least a part of said rotatable blade and having an inner diameter larger than the outer diameter of said rotatable blade and a plurality of guide vanes secured to the inner surface of said casing such that said guide vanes are disposed in juxtaposition with at least a part of said rotating blade in the axial direction thereof and extend downstream beyond the end of said rotatable blade, said guide vanes having a radial height smaller than the radial gap between said casing and said rotatable blade, each of said guide vanes having a thickness of substantially the same order as that of said rotatable blade and being twisted in the opposite direction to the direction of twisting of said rotating blade so that the swirling flow of the fluid such as air around the blade end during the rotation thereof is smoothly guided along the guide vanes toward the discharge side of the fan.

3. An axial fan comprising a rotating blade, motor means drivingly connected to said blade for effecting rotation thereof, a casing covering at least a part of said rotating blade and having an inner diameter larger than the outer diameter of said rotating blade and a plurality of guide vanes secured to the inner surface of said casing such that said guide vanes are disposed in juxtaposition with at least a part of said rotating blade in the axial direction thereof and having a radial height smaller than the radial gap defined between said casing and said rotating blade, each of said guide vanes being constituted by a rigid body having a thickness of substantially the same order as that of said rotating blade and twisted in the opposite direction to the direction of twisting of said rotating blade.

4. An axial fan as claimed in claim 3 wherein said guide vanes extend over an axial extent of at least 70% of that of said rotating blade.

5. An axial fan as claimed in claim 3 wherein said casing covers the axial extent of said rotating blade and wherein said guide vanes cover the axial extent of said rotating blade.

6. An axial fan as claimed in claim 3 wherein said radial height of said guide vanes amounts to at least 3% of said outer diameter of said rotating blade.

7. An axial fan as claimed in claim 3 wherein said radial height of said guide vanes amounts to 5 to 15% of said outer diameter of said rotating blade.

8. An axial fan as claimed in claim 3 wherein said guide vanes are mounted on the inner surface of the casing such that the guide vanes are oriented in right angled relation with the rotating blade.

9. An axial fan as claimed in claim 3 further comprising stator blades each disposed in said discharge space and connected to the discharge-side end of the respective guide vanes.

10. An axial fan as claimed in claim 3 wherein said casing covers at least a part of said rotating blade close to a discharge spaced and wherein said guide vanes are arranged in juxtaposition with at least a part of said rotating blade on the side of said discharge space.

11. An axial fan as claimed in claim 10 wherein the end of said casing close to said discharge space projects beyond the rotating blade toward the discharge space and wherein the ends of said guide vanes close to said discharge space projects beyond the rotating blade into the discharge space.

12. An axial fan as claimed in claim 11 wherein the end of said casing close to the suction space extends beyond the axial lengthwise center of said rotating blade toward said suction space, said guide vanes have an axial extent larger than that of said rotating blade and wherein the ends of said guide vanes close to said suction space extend beyond said axial lengthwise center of said rotating blade toward said suction space.

13. An axial fan as claimed in claim 3 further comprising a baffle plate disposed close to the suction-side end of said rotating blade thereby to limit the inlet flow of air axially of said rotating blade and adapted to define an air inlet opening in cooperation with said casing.

14. An axial fan as claimed in claim 13 wherein said casing covers the axial extent of said rotating blade and that said guide vanes are so arranged as to cover at least a part of the axial extent of said rotating blade.

15. An axial fan as claimed in claim 13 wherein said baffle plate is movably mounted in the axial direction of said rotating blade.

16. An axial fan as claimed in claim 13 wherein said guide vanes are removably mounted.

17. An axial fan as claimed in claim 13 wherein said baffle plate is adapted to impede said inlet axial flow of air.

18. An axial fan as claimed in claim 17 wherein said inlet opening opens in the axial direction of said rotating blade.

19. An axial fan as claimed in claim 18 wherein a part of said rotating blade extends axially thereof beyond the end of the casing toward the inlet opening.

20. An axial fan as claimed in claim 19 wherein said guide vanes are so arranged as to cover at least a part of axial extent of said rotating blade.

* * * * *